US008011144B2

(12) United States Patent
Compton

(10) Patent No.: US 8,011,144 B2
(45) Date of Patent: Sep. 6, 2011

(54) SYSTEM FOR FORMING AND INSULATING CONCRETE SLAB EDGES

(75) Inventor: Robert Thomas Compton, Wichita, KS (US)

(73) Assignee: EnergyEdge, LLC, Wichita, KS (US)

( * ) Notice: Subject to any disclaimer, the term of this patent is extended or adjusted under 35 U.S.C. 154(b) by 1233 days.

(21) Appl. No.: 11/174,203

(22) Filed: Jul. 1, 2005

(65) Prior Publication Data

US 2006/0000168 A1 Jan. 5, 2006

Related U.S. Application Data

(60) Provisional application No. 60/585,305, filed on Jul. 3, 2004.

(51) Int. Cl.
*E04B 1/00* (2006.01)

(52) U.S. Cl. ..... 52/169.11; 52/295; 52/299; 52/677; 52/699; 249/2

(58) Field of Classification Search ..... 52/169.5, 52/169.11, 292, 293, 299, 415, 294, 295, 52/677, 678, 699; 249/2–9
See application file for complete search history.

(56) References Cited

U.S. PATENT DOCUMENTS

| | | | | | |
|---|---|---|---|---|---|
| 1,628,316 | A | * | 5/1927 | Heltzel | 249/5 |
| 1,672,760 | A | * | 6/1928 | Heltzel | 249/208 |
| 1,918,710 | A | * | 7/1933 | Mosel et al. | 249/6 |
| 2,031,612 | A | * | 2/1936 | Masor | 249/7 |
| 3,435,580 | A | | 4/1969 | Merrill et al. | |
| 3,561,175 | A | | 2/1971 | Best et al. | |
| 4,065,893 | A | | 1/1978 | Epes | |
| 4,335,548 | A | | 6/1982 | Rehbein | |
| 4,524,553 | A | * | 6/1985 | Hacker | 52/169.11 |
| 4,711,058 | A | | 12/1987 | Patton | |
| 5,174,083 | A | * | 12/1992 | Mussell | 52/169.1 |
| 5,224,321 | A | * | 7/1993 | Fearn | 52/741.15 |
| 5,399,050 | A | | 3/1995 | Jacobus | |
| 5,596,860 | A | | 1/1997 | Hacker | |
| 5,609,005 | A | | 3/1997 | Schierloch et al. | |
| 5,694,723 | A | | 12/1997 | Parker | |
| 5,771,643 | A | | 6/1998 | Parker | |
| 5,803,669 | A | | 9/1998 | Bullard | |
| 5,857,297 | A | | 1/1999 | Sawyer | |
| 6,021,994 | A | * | 2/2000 | Shartzer, Jr. | 249/6 |
| 6,212,831 | B1 | | 4/2001 | White | |
| 6,332,599 | B1 | | 12/2001 | Spartz | |
| 6,629,394 | B1 | * | 10/2003 | Trevino | 52/677 |
| 6,874,288 | B1 | * | 4/2005 | Washa et al. | 52/371 |
| 2004/0000626 | A1 | | 1/2004 | Takagi | |

* cited by examiner

*Primary Examiner* — William V Gilbert
(74) *Attorney, Agent, or Firm* — Crowe & Dunlevy

(57) ABSTRACT

The slab edge forming and insulating system includes edge members and support braces. The edge members include an elongated shell having an upright portion with an insulated inside surface, an upper portion and a lower portion. Each of the upper and lower portions have formed edges. Open cross sectioned support braces having upper and lower formed edges for engaging the formed edges of the elongated shell are fixed to a footing and connected to the edge members. The edge members form and insulate the edges of the poured concrete of the slab while the open cross sectioned support braces receive the poured concrete of the slab and thus anchor the edge members to the edge of the slab.

13 Claims, 9 Drawing Sheets

SYSTEM FOR FORMING AND INSULATING CONCRETE SLAB EDGES

CROSS REFERENCES TO RELATED APPLICATIONS

This application claims the benefit of U.S. Provisional Patent Application No. 60/585,305 filed Jul. 3, 2004.

FIELD OF THE INVENTION

The present invention relates to a system for forming and insulating the perimeter of a concrete slab.

BACKGROUND OF THE INVENTION

The perimeter of a concrete slab edge typically presents an uninsulated seam between the foundation and the walls of a building. Generally, planks of lumber have been used to define the perimeter of a concrete slab. Once a concrete slab is poured and cures, such prior art edge forms are removed. What is needed is a system for forming the perimeter of a slab which also stays in place to protect and insulate the perimeter of the slab. Preferably, this system for forming and insulating the perimeter of a slab must be able to withstand harsh exposure to moisture in its various states, ultra violet light, temperature extremes, pests, vegetation and physical abuse.

BRIEF DESCRIPTION OF THE INVENTION

The aforementioned need is addressed by providing a slab edge forming and insulating system. The slab edge forming and insulating system includes edge members and support braces. Each edge member includes an elongated shell. The cross section of an elongated shell includes an upright portion, a generally horizontal upper portion and a generally horizontal lower portion. Each of the upper and lower portions have a formed edge opposite the upright portion. Insulation material covers the inside surface of the upright portion. Support braces are fixed to the footing and spaced for supporting the edge members. The support braces include upper and lower formed edges for engaging the formed edges of the elongated shell. The support braces have an open cross section for receiving poured concrete. The support braces are attached to the edge members and fastened to the footing such that the edge members are arranged in a fixed configuration to define the desired perimeter of the slab. The edge members form and insulate the edges of the poured concrete of the slab while the open cross sectioned support braces receive the poured concrete of the slab and thus anchor the edge members to the edge of the slab.

The method for using the slab edge system includes the following steps. Edge members and support braces are provided at a construction site. The construction site includes a foundation footing which generally defines the perimeter of the desired slab. The edge members are connected together to define a perimeter form for a concrete slab. The support braces are attached to the edge members at desired intervals. The assembled system is preferably anchored to the foundation footing by fasteners common to the support braces and the footing. Concrete mix is poured inside the area bounded by the edge members to a level that is generally even with upper surfaces of the edge members. As the concrete cures, the edge system is permanently fixed to the slab perimeter thus providing protection and insulation for the edge of the slab.

DETAILED DESCRIPTION

Figures 1, 1A, 1B:
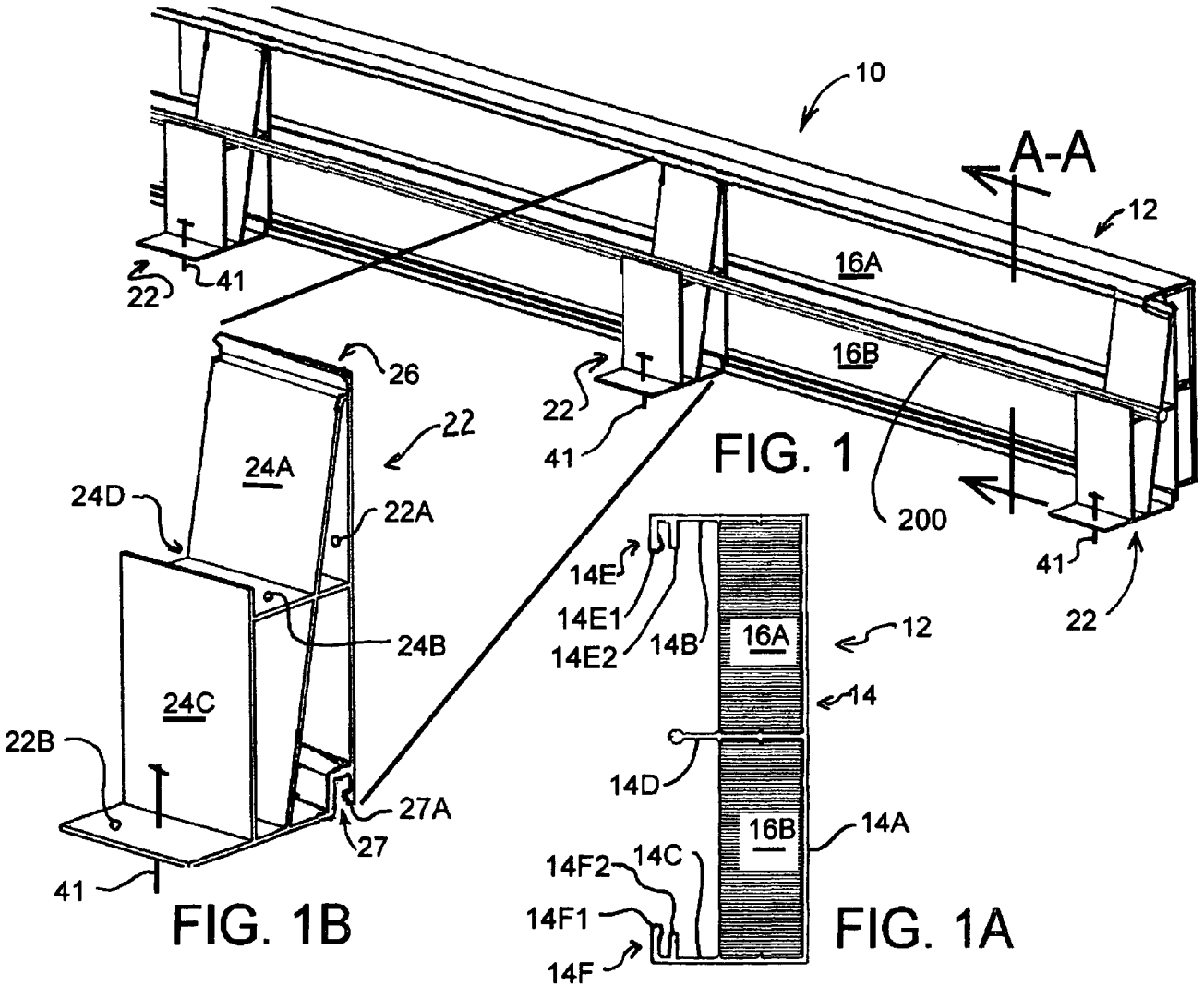
FIG. 1 is a perspective view of an embodiment of the slab edge system of the present invention.
FIG. 1A is a cross section view of an edge member taken from plane A-A of FIG. 1.
FIG. 1B is a magnified view of a support brace.

Referring to the drawings, FIGS. 1-1B show a slab edge system 10 in accordance with an embodiment of the present invention. As can be seen in FIG. 1, edge system 10 includes an edge member 12, spaced support braces 22 and an optional reinforcing bar 200.

A cross section of edge member 12 is shown in FIG. 1A. Edge member 12 functions as a form for molding the perimeter of a concrete slab as well as a means for insulating the perimeter of the slab. Edge member 12 is not removed upon formation of the slab edge but remains fixed to the perimeter of the slab even after the slab has cured and hardened. As can be seen in FIG. 1A, edge member 12 includes a shell portion 14 and two insulation inserts 16A and 16B. Shell portion 14 is preferably a one-piece profile which includes a upright portion 14A, an upper portion 14B, a lower portion 14C and an intermediate flange 14D. Intermediate flange 14D decreases the depth to thickness ratio of upright portion 14A which increases the compressive capacity of edge member 12. Insulation insert 16A is installed between upper portion 14B and intermediate flange 14D while insulation insert 16B is installed between intermediate flange 14D and lower portion 14C. Shell portion 14 is preferably fashioned by extruding polyvinyl chloride (PVC) or a comparable material through a suitable extrusion die. The PVC of shell portion 14 preferably includes a UV protective agent for preventing degradation due to solar radiation. Insulation inserts 16A and 16B are preferably fashioned from expanded polystyrene (EPS) insulation. Insulation inserts 16A and 16B do not need to be strong or durable because they will be protected by shell portion 14 and concrete.

Shell portion 14 also includes features for engaging support braces 22. An upper locking slot 14E and a symmetrically identical lower locking slot 14F extend from the distal ends of upper portion 14B and lower portion 14C respectively. Because these features are symmetrical, only upper locking slot 14E will be described here in detail. Upper locking slot 14E includes a first flange 14E1 and a second flange 14E2. First flange 14E1 presents a thicker portion at its distal end while the slightly shorter second flange 14E2 has a generally uniform thickness. Since first and second flanges 14E1 and 14E2 are fashioned from a generally flexible material, they present an opening for receiving and engaging a correspondingly shaped feature extending from a support brace 22.

Support braces 22 support and fix the locations for edge members 12. Support braces 22 are designed to inter-fit with shell portion 14 of edge member 12. Support braces 22 are spaced at appropriate intervals and they have open cross sections for receiving concrete mix. Accordingly, support braces 22 are designed to become imbedded within a concrete slab. If properly connected to an edge member 12, they will anchor edge member 12 to the finished concrete slab. Also, if properly connected and secured to an underlying footing, support braces 22 will hold edge members 12 in place while slab concrete is poured. Support brace 22 as shown in FIG. 1B is preferably a one piece extruded profile. It includes a upright portion 22A, a base flange 22B, a diagonal web 24A, a horizontal web 24B and a upright web 24C.

Support brace 22 includes features for engaging locking slots 14E and 14F of edge member 12. A flange portion 26 and a slot portion 27 are positioned and shaped to engage locking slots 14E and 14F. Flange portion 26 extends from the upper end of upright portion 22A, while slot portion 26B is located at the intersection of upright portion 22A and base flange 22B. Flange portion 26 is thicker at its distal end for fitting into the compatibly shaped opening presented by upper locking slot 14E of edge member 12. Slot portion 27 includes a flange portion 27A which also includes a thick distal end which generally fits the opening presented by lower locking slot 14F of edge member 12. FIG. 1 shows that a support brace 22 may be located at the end of an edge member 12. If a second edge member is connected to support brace 22 adjacent to the first edge member, then support brace 22 may function as a means for joining two adjacent edge members.

Figure 5:
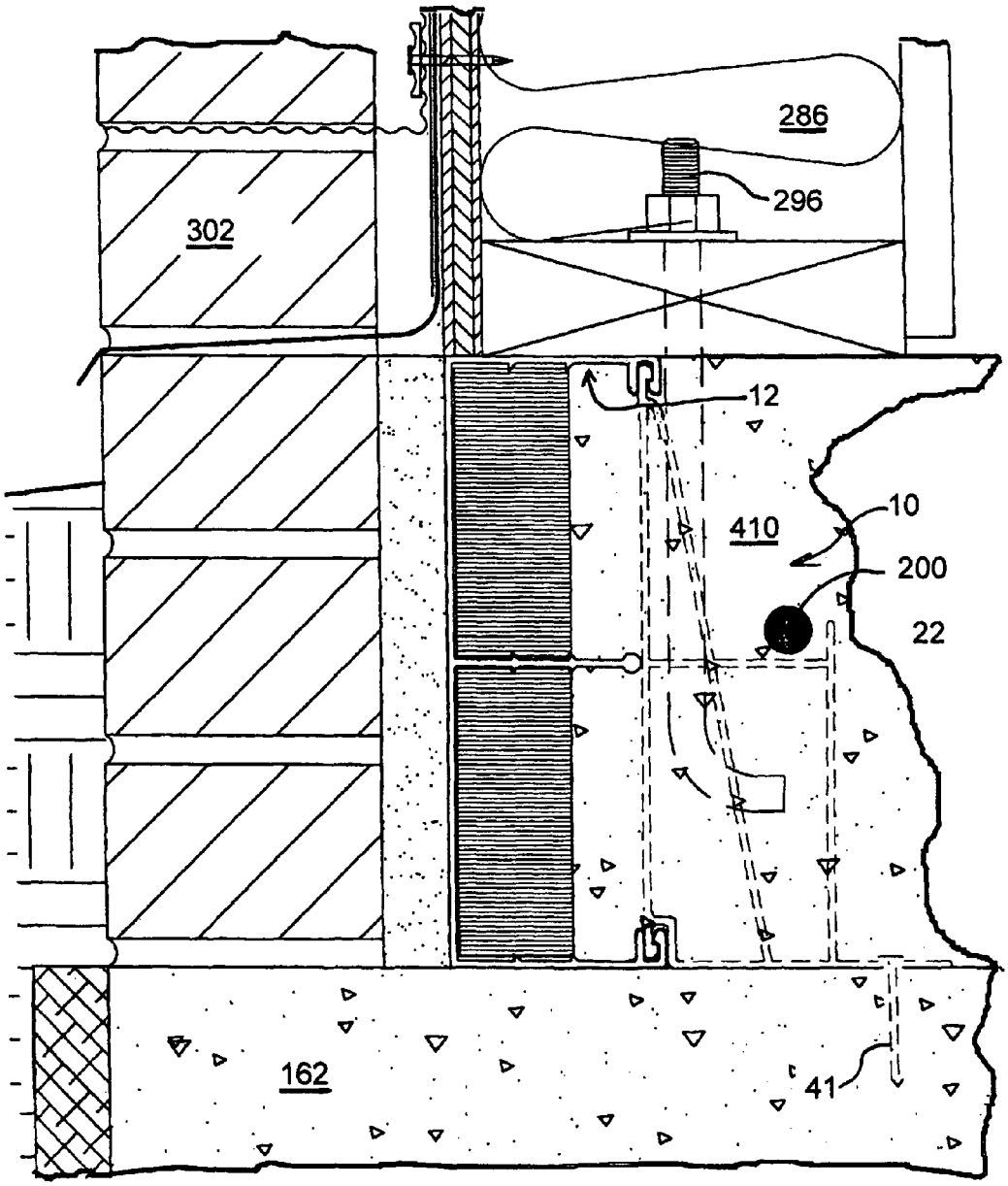
FIG. 5 is a cross section view of a first embodiment of the slab edge system of the present invention.

Support brace 22 offers a reinforcing bar support pocket 24D for supporting reinforcing bar 200 as shown in FIG. 5. As is shown in FIG. 1B, the exposed upper surface of horizontal web 24B, the inside surface of upright web 24C and the outside surface of diagonal web 24A of support brace 22 define reinforcing bar support pocket 24D. The support of reinforcing bar 200 by support pockets 24D is a useful feature of this system because it is preferable to reinforce the edges of a concrete slab with a reinforcing bar. However, a reinforcing bar will often not maintain its preferred position relative to the edge of the slab. Workmen manipulating other reinforcing materials will often cause the edge reinforcing bars to be trampled down to a less effective lower position. The support of reinforcing bar 200 by support braces 22 fixes the relative location of the reinforcing bar within the edge of the concrete slab. Yet, reinforcing bar support pocket 24D is relatively wide in the horizontal direction to accommodate the relatively inexact geometry of typical reinforcing bar material.

It is preferable to fix support braces 22 to an underlying footing by using fasteners. As is shown in FIG. 5, a fastener 41, which is preferably a concrete nail, penetrates base flange 22B of support brace 22 to anchor support brace 22 to footing 162. Fastener 41 may be installed using a nail gun and this operation is particularly easy to execute when the concrete of underlying footing 162 is "green", that is substantially solid but recently poured and therefore only partially set. When support braces 22 are anchored by fasteners 41, edge system 10 remains stationary during the pouring of concrete mix to complete a foundation slab. Support braces 22 are also fashioned from an extruded cross section and are preferably made from extruded polyvinyl chloride (PVC) or a comparable, suitably strong material. Preferably the cross section of support brace 22 is extruded and then cut into short sections to produce individual support braces 22.

Figure 2:
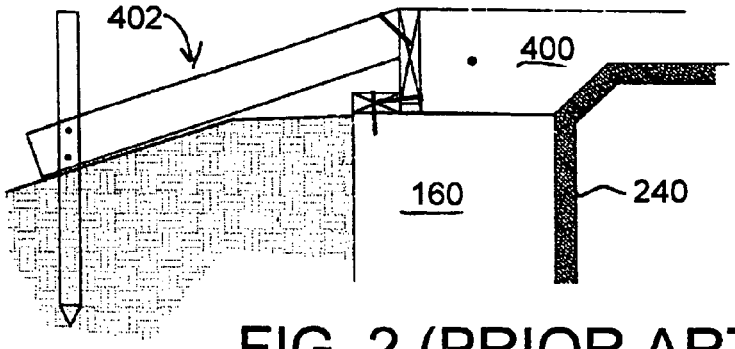
FIG. 2 (PRIOR ART)
FIG. 2 is side view of a typical prior art arrangement for forming a slab.
Figure 3:
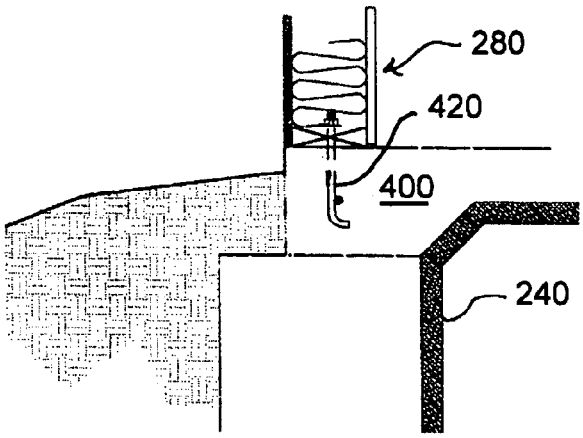
FIG. 3 (PRIOR ART)
FIG. 3 is side view of a typical prior art slab with an insulated wall package erected at the edge of the slab.

Edge system 10 is better understood after considering a typical prior art arrangement for forming a concrete slab edge. FIG. 2 illustrates typical prior art building assembly practice. In FIG. 2, poured concrete slab 400 is supported by typical edge supports consisting of various lengths of lumber 402. In FIG. 3, a prior art building assembly is shown including an insulated wall package 280 secured to a slab 400 by anchor bolts 420. A footing 160 supports the perimeter of slab 400. An insulation system 240 covers adjacent surfaces of footing 160 and slab 400. As can be seen in FIG. 3, an uninsulated gap exists between insulation system 240 and insulated wall package 280. Heat escapes through this uninsulated gap.

Figure 4:
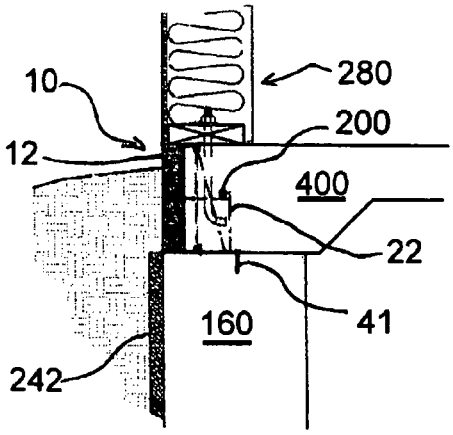
FIG. 4 is a side view of the insulated slab edge system of the present invention shown with a foundation system and a typical insulated wall package.

Edge system 10 shown in FIG. 4 preserves much of the configuration of FIG. 3 and is compatible with most of the standard building details shown in FIG. 3. In FIG. 4, edge system 10 is positioned on the outside face of the slab 400 thus creating the proper thermal envelope between foundation insulation 242 and insulated wall package 280. In FIG. 4, foundation insulation 242 is placed on the outside surface of foundation 160 rather than the inside surface of footing 160 as shown in FIG. 2.

FIG. 5 illustrates edge system 10 installed at the edge of a concrete slab 410. The building structure shown in FIG. 5 by way of example also includes a brick veneer 302, a concrete footing 162 and a wall package 286. In FIG. 5, wall package 286 is anchored by a series of anchor bolts 296 which are embedded in slab 410. Edge system 10 includes the same edge member 12 and interconnected support braces 22 as described above. Support braces 22 are illustrated with hidden lines because they are imbedded in concrete slab 410. Reinforcing bar 200 is also imbedded in concrete slab 410 and is shown in cross section in FIG. 5.

Figure 6:
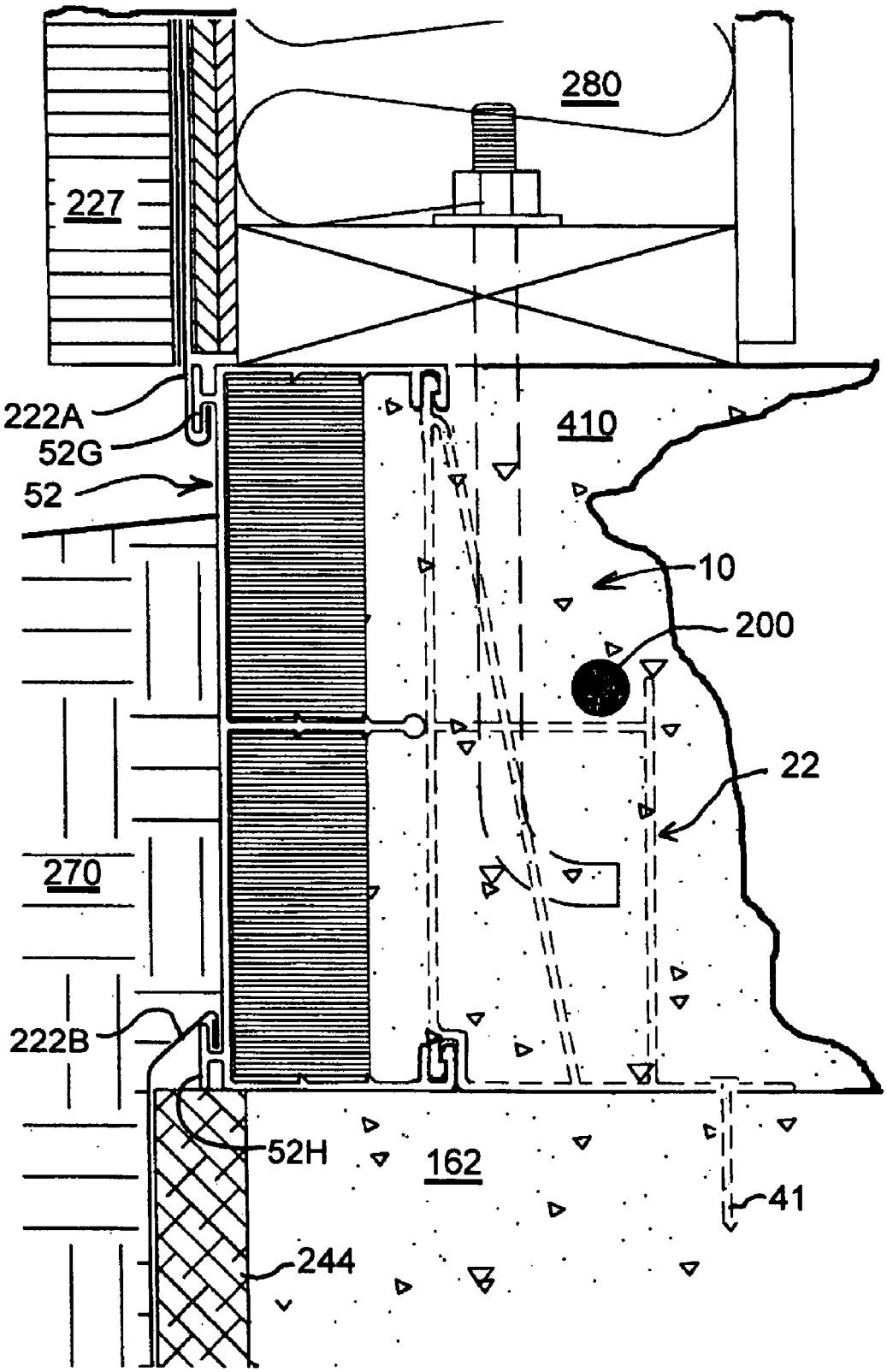
FIG. 6 is a cross section view of a second embodiment of the slab edge system of the present invention.

FIG. 6 illustrates a second edge system 10A which is a second embodiment of the present edge system. In FIG. 6, edge member 12 is replaced by an edge member 52 which is adapted for use with an exterior insulating system 227. Exterior insulating system 227 requires a flashing 222A for conducting moisture from the bottom of an exterior finish system 227. Flashing 222A also provides a continuous seal at the base of wall system 280. Accordingly, edge member 52 includes a grooved projection 52G at its upper end for receiving the lower edge of flashing 222A. Edge member 52 also includes a second grooved projection 52H at its lower end for accommodating a flashing 222B. Flashing 222B covers foundation insulation 244. This allows for protected backfill 270 or protects otherwise exposed foundation insulation 244. Except for the addition of grooved projections 52G and 52H, the details of edge system 10A are generally identical to the details of edge system 10 described above.

Figure 7:
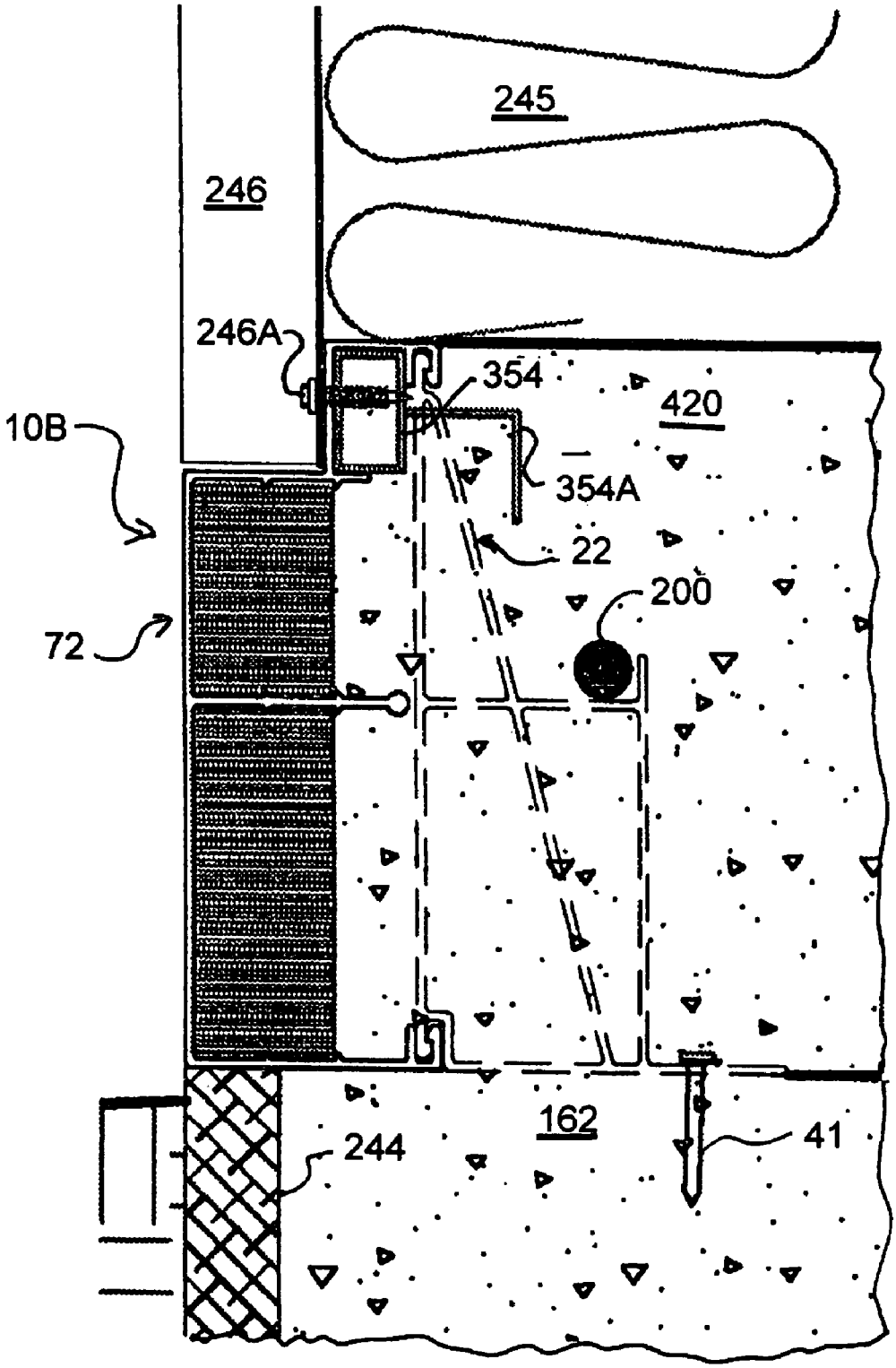
FIG. 7 is a cross section view of a third embodiment of the slab edge system of the present invention.

FIG. 7 illustrates a third edge system 10B which is a third embodiment of the present edge system which is generally intended for use with metal building systems. In FIG. 7, edge member 12 is replaced by an edge member 72 which is adapted for use with wall package 245 which includes exterior panels 246. Edge member 72 is shaped to provide a recess for receiving exterior building panels 246. Edge member 72 is also adapted to receive an optional reinforcing tube 354. Fasteners 246A may be used to secure the bottom edge of panel 246 to the recessed wall of edge member 72 and to optional reinforcing tube 354 if present. Preferably, optional reinforcing tube 354 includes spaced projecting elements 354A for anchoring reinforcing tube 354 to slab 420.

Figure 8A:
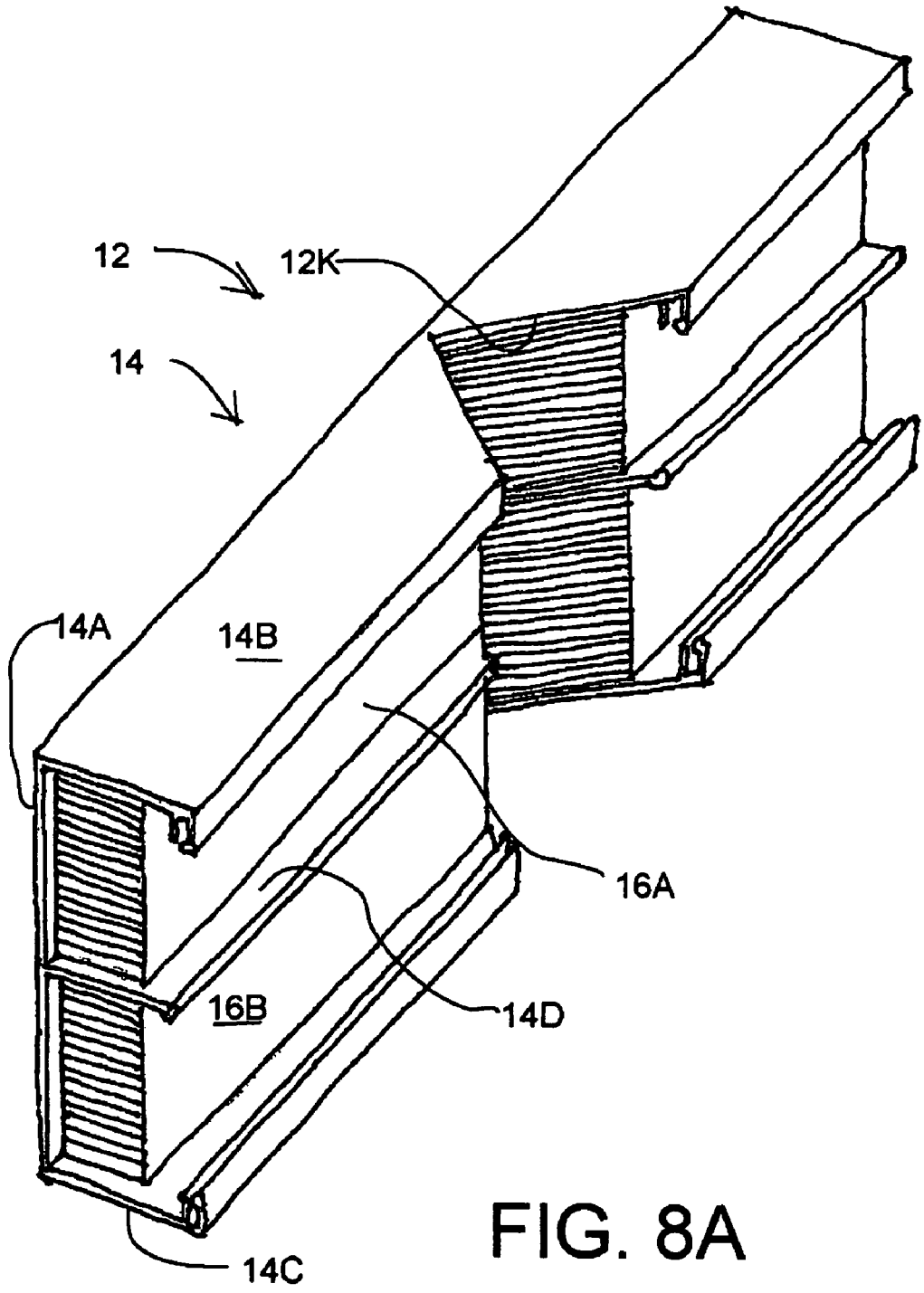
FIG. 8A is a perspective view of a kerfed section of an edge member.
Figure 8B:
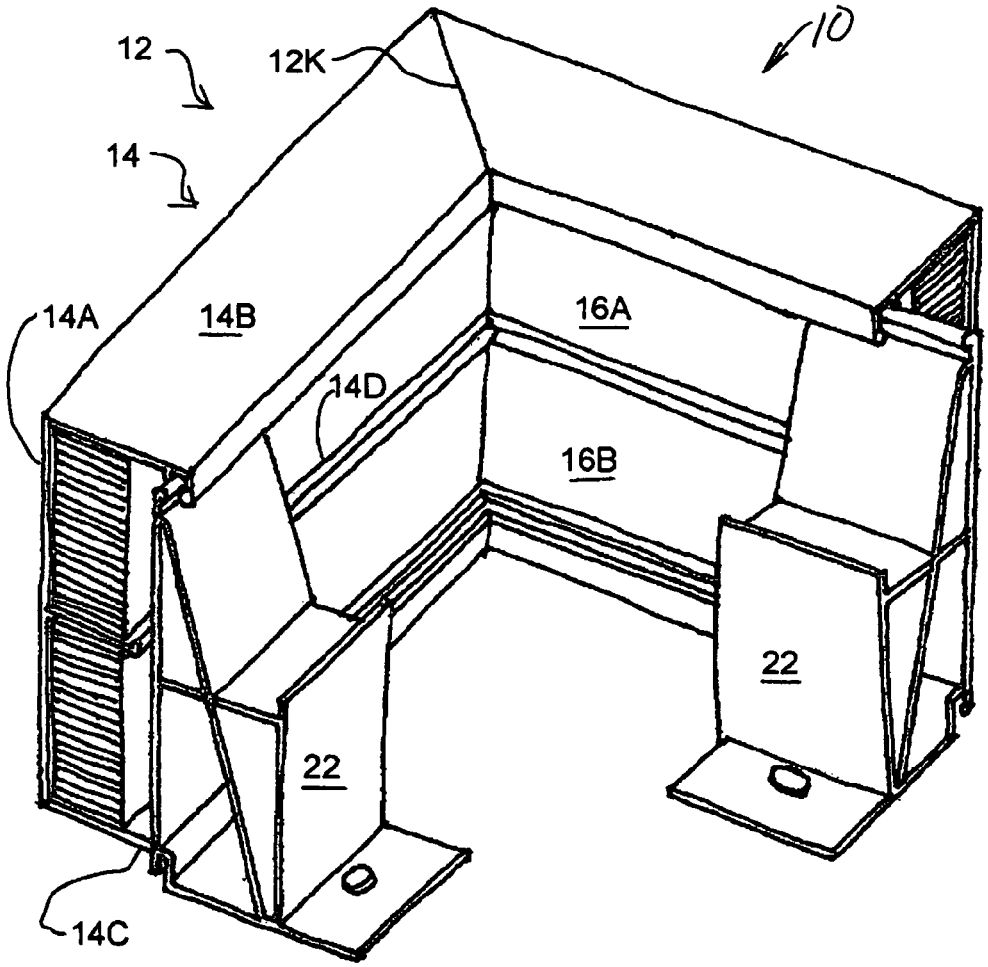
FIG. 8B is a perspective view of a kerfed section of an edge member formed to accommodate a corner.

FIGS. 8A and 8B illustrate how an edge member 12 may be kerfed to define a corner. In FIG. 8A, edge member 12 includes a kerf 12K which is a right angle cut out removing portions of upper portion 14B, lower portion 14C, insulation inserts 16A and 16B and center wall 14D. Upright wall 14A is not effected by kerf 12K. Because edge member 12 is made from a flexible material, kerfed edge member 12 may be formed as shown in FIG. 8B. Adjacent brace members 22 reinforce and support the corner shown in FIG. 8B.

Figure 9A:
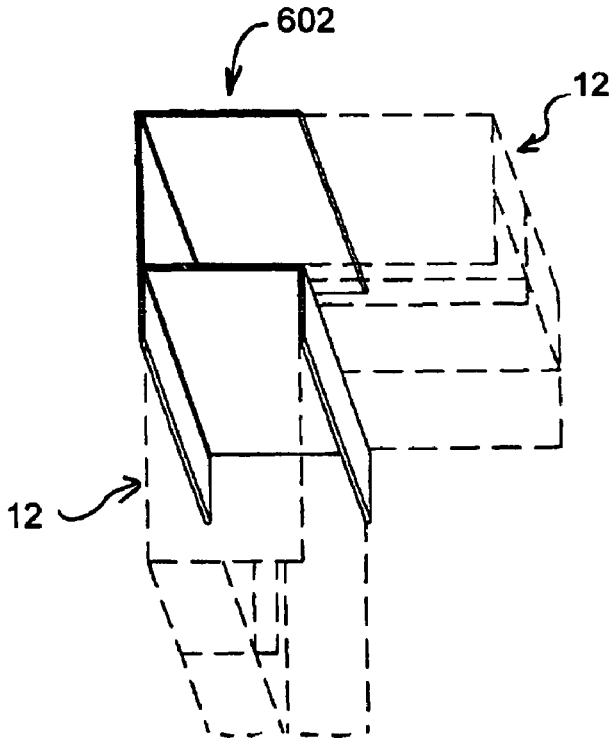
FIG. 9A is a perspective view of a square corner fitting used to make a square corner in the edge system.
Figure 9B:
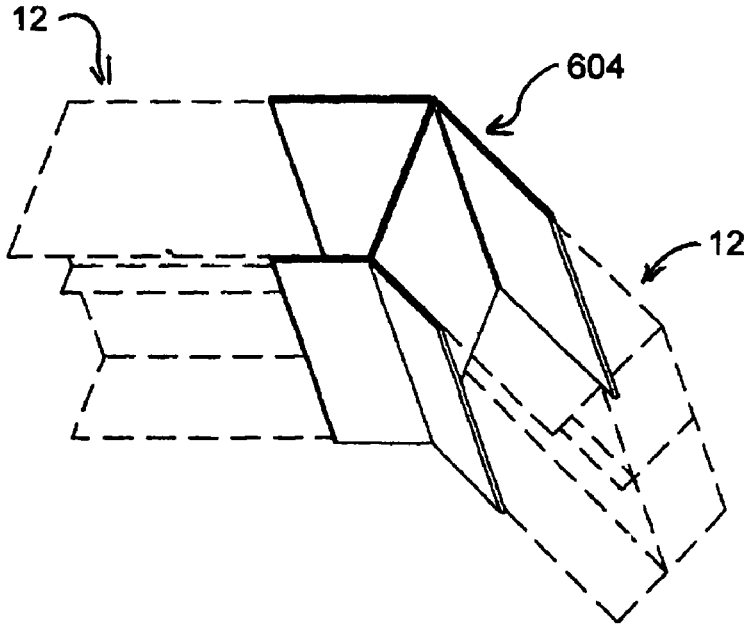
FIG. 9B is a perspective view of an angled corner fitting used to make an angled corner in the edge system.
Figure 9C:
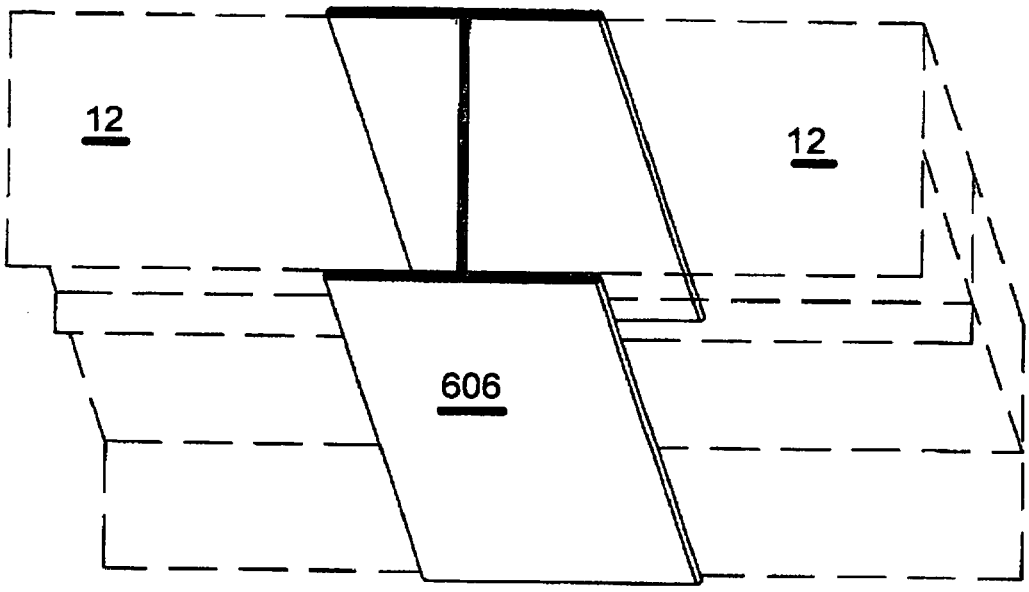
FIG. 9C is a perspective view of an angled joint fitting used to make straight joints in the edge system.

FIGS. 9A, 9B and 9C illustrate joint fittings for joining sections of edge members 12 to form corners or to form straight joints. A square corner fitting 602 is shown in FIG. 9A. In FIG. 9A two edge members 12 are received by square corner fitting 602 to fashion a square joint. An angled corner fitting 604 is shown in FIG. 9B. In FIG. 9B two edge members 12 are received by angled corner fitting 604 to fashion an angled joint. If the edge members in FIG. 9A or 9B are reversed, then the respective joint fittings can be used to fashion an inside corner. In FIG. 9C two edge members 12 are received by straight fitting 606 to fashion a straight joint. Although not shown in FIGS. 9A-9C, it would be preferred to install brace members 14 on both sides of the joints shown in FIGS. 9A-9C.

The method for installing slab edge systems 10 includes the following steps. Edge members 12 and support braces 22 are provided at a construction site. The construction site includes a concrete foundation footing which generally defines the desired perimeter of the desired slab. The edge members 12 are located and connected together and positioned to define a perimeter form for the intended concrete slab. Edge members 12 are preferably arranged on the top surface of the footing. Edge members 12 are positioned such that the outer walls of shell portions 14 are oriented away from the interior of the slab and such that the upper surfaces of upper portions 14B of shell portions 14 are generally level and co-planer. Edge members 12 may be kerfed as shown in FIG. 8B to accommodate the desired corners or may be fit together with corner fittings 600 as shown in FIG. 9A-9C. Support braces 22 are attached to edge members 12 at desired intervals such that support braces 22 extend into the interior of the slab. Fasteners 41 are used to anchor support braces 22 and edge members 12 such that the edge member 12 and support brace 22 assembly remains in fixed positions. Optionally, a reinforcing bar 200 can be arranged upon reinforcing bar pockets 24D of support braces 22. Concrete mix is then poured inside the area bounded by edge members 12 to a level that is generally even with the upper surfaces of upper portion s 14B of shell portions 14. As the concrete cures, support braces 22 and by extension, edge members 12 are fixed to the slab perimeter thus protecting and insulating the edge of the slab.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. A system for forming and insulating the edges of a concrete slab, the system comprising:

an edge member, wherein the edge member includes:
- an edge member upright portion;
- an edge member lower portion; and
- insulation disposed adjacent to the edge member upright portion and lower portion; and a support brace connected to the edge member, wherein the support brace includes:
- a support brace upright portion that is substantially parallel to the edge member upright portion; and
- a support brace base flange connected to the support brace upright portion, wherein the support brace base flange is substantially coplanar with the edge member lower portion and having a portion that extends away from a lower portion of the support brace upright portion; and
- whereby the insulation would be located between the edge member upright portion and the concrete slab, and the support brace would be embedded within the concrete slab.

2. The system of claim 1, wherein the support brace further includes an upright web connected to the support brace base flange, wherein the upright web is substantially parallel to the support brace upright portion.

3. The system of claim 1, wherein the support brace further includes a horizontal web connected to the support brace upright portion, wherein the horizontal web is substantially parallel to the support brace base flange.

4. The system of claim 1, wherein the support brace further includes a diagonal web connected between the support brace upright portion and the support brace base flange.

5. The system of claim 1, wherein the edge member lower portion includes a first locking slot.

6. The system of claim 5, wherein the support brace base flange includes a slot portion configured for interleaved engagement with the first locking slot of the edge member lower portion.

7. The system of claim 1, wherein the edge member further comprises an edge member upper portion connected to the edge member upright portion and extending substantially parallel to the edge member lower portion.

8. The system of claim 7, wherein the edge member upper portion includes a second locking slot.

9. The system of claim 8, wherein the support brace upright portion includes a flange portion configured for interleaved engagement with the second locking slot of the edge member upper portion.

10. The system of claim 7, wherein the edge member further comprises an intermediate flange extending from the edge member upright portion between the edge member upper portion and edge member lower portion.

11. The system of claim 10 further comprising:
- an upper insulating portion disposed between the edge member upper portion and the intermediate flange; and
- a lower insulating portion disposed between the intermediate flange and the edge member lower portion.

12. The system of claim 1, further comprising a fastener that extends through the base flange.

13. The system of claim 1, wherein the support brace is manufactured from extruded polyvinyl chloride.

* * * * *